United States Patent [19]

Castonguay et al.

[11] Patent Number: 4,894,632

[45] Date of Patent: Jan. 16, 1990

[54] MOLDED CASE CIRCUIT BREAKER OPERATING MECHANISM FOLD-DOWN ARRANGEMENT

[76] Inventors: Roger N. Castonguay, 5 Ellen Dr., Terryville, Conn. 06786; David J. Meiners, 186 Pondview Dr., Southington, Conn. 06489

[21] Appl. No.: 274,224

[22] Filed: Nov. 21, 1988

[51] Int. Cl.[4] ..... H01H 9/02

[52] U.S. Cl. ..... 335/202; 335/8; 200/293

[58] Field of Search ..... 335/8–10, 335/6, 35, 36, 202, 172–174; 200/293, 303, 314, 315

[56] References Cited

U.S. PATENT DOCUMENTS

| | | | |
|---|---|---|---|
| 3,235,689 | 2/1966 | Poulton, Jr. | 335/10 |
| 3,603,755 | 9/1971 | Ranzanign | 200/293 |
| 4,286,130 | 8/1981 | Troebel | 200/303 |
| 4,527,027 | 7/1985 | Link et al. | 200/303 |
| 4,713,635 | 12/1987 | Flick et al. | 335/8 |
| 4,733,211 | 3/1988 | Castonguay et al. | 335/192 |
| 4,736,174 | 4/1988 | Castonguay et al. | 335/167 |
| 4,752,755 | 6/1988 | Nakano et al. | 335/202 |
| 4,754,247 | 6/1988 | Raymont et al. | 335/202 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A circuit breaker operating mechanism employs a multi-latch arrangement for controlling the automatic opening of the circuit breaker contacts upon predetermined overcurrent conditions. The multi-latch assembly is robotically assembled to the operating mechanism and is retained thereon by means of a retainer tab. The circuit breaker case and cover contain integrally formed steps which receive extensions formed on the operating mechanism assembly. The operating mechanism assembly becomes wedged between the circuit breaker cover and case when the cover is later fastened to the case.

10 Claims, 4 Drawing Sheets

MOLDED CASE CIRCUIT BREAKER OPERATING MECHANISM FOLD-DOWN ARRANGEMENT

BACKGROUND OF THE INVENTION

Molded case circuit breakers of the type consisting of one or more pairs of separable contacts controlled by an operating mechanism are designed for automatic assembly. The operating mechanism is pre-assembled off-line and is later robotically assembled to the circuit breaker case before the circuit breaker cover is robotically attached.

One of the problems involved in the circuit breaker assembly is that the circuit breaker operating mechanism must remain fixedly in place within the circuit breaker case. Rivets and screws were earlier required to fasten the operating mechanism assembly and required insertion either through the bottom of the base or through the interior side walls thereof. The use of screws and rivets also requires larger size components to accommodate fastening the screws and the rivets to the components.

A further hinderance to breaker assembly when an independent latch assembly is used is the requirement that the latch assembly also be attached to the operating mechanism assembly by means of rivets or screws. The use of such rivets or screws in a highly automated assembly process requires considerable time and dexterity on the part of the assembly robot as well as requiring larger-sized components.

One purpose of the instant invention accordingly is to provide for attachment between the circuit breaker latch assembly and the operating mechanism assembly without requiring screws or rivets.

Another purpose of this invention is to secure the operating mechanism within the circuit breaker enclosure without any additional means of attachment.

SUMMARY OF THE INVENTION

A pair of retention slots is integrally formed on the side frame of a circuit breaker operating mechanism for receiving a pair of posts extending from the circuit breaker latch subassembly in an automated assembly process. The operating mechanism is attached to the circuit breaker case by inserting an extension on the operating mechanism assembly within an extended slot integrally formed within the circuit breaker case interior. The circuit breaker operating mechanism is secured within the circuit breaker enclosure by means of legs formed on the bottom of the operating mechanism assembly and arms extending from the top part thereof. Corresponding steps integrally formed within the circuit breaker cover trap the arm extensions thereunder while steps integrally formed within the circuit breaker case receive the legs on the bottom part thereof. When the cover is later secured to the base, the arm extensions and the legs become trapped between circuit breaker cover and case respectively in a press-fit relation.

DESCRIPTION OF THE PREFERRED EMBODIMENT

Figure 1:
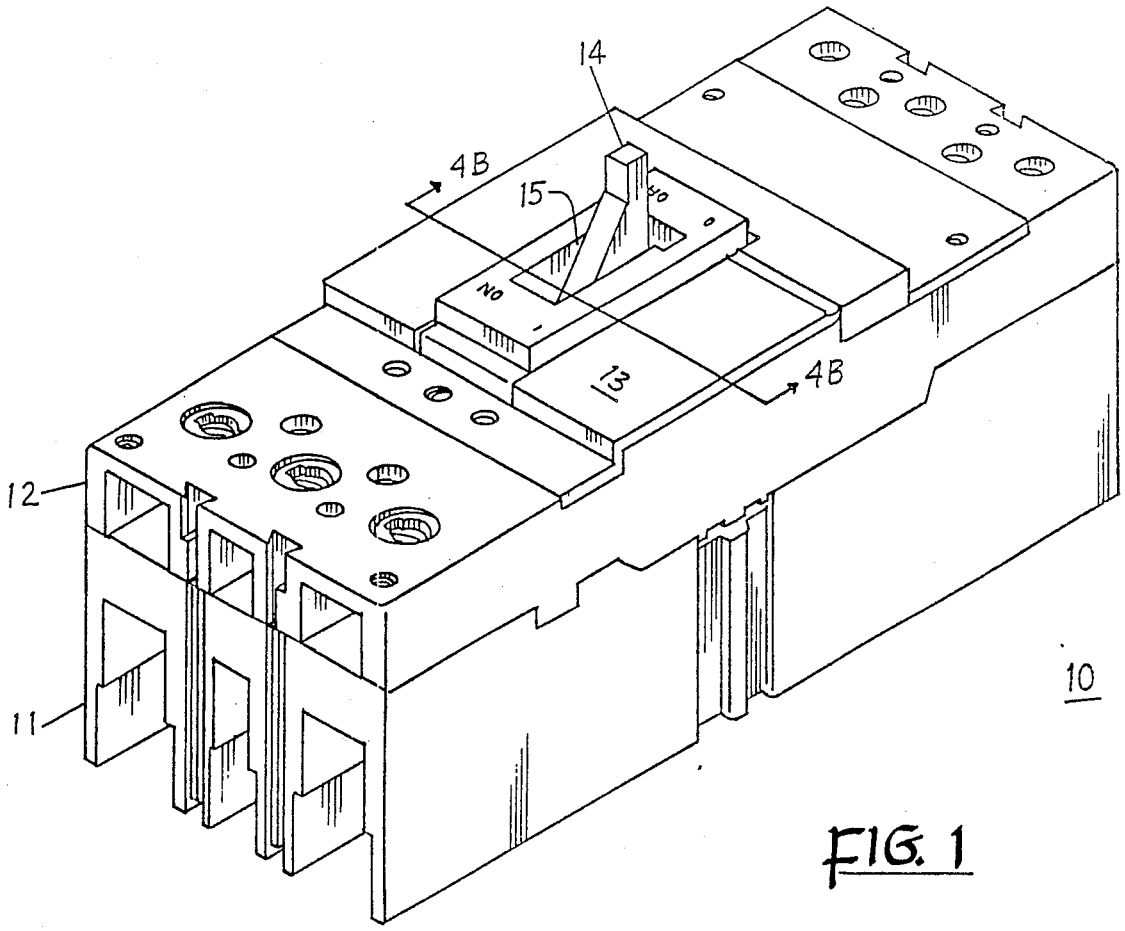
FIG. 1 is a top perspective view of a molded case circuit breaker including the circuit breaker latch and operating mechanism attachment means according to the invention.
Figure 2:
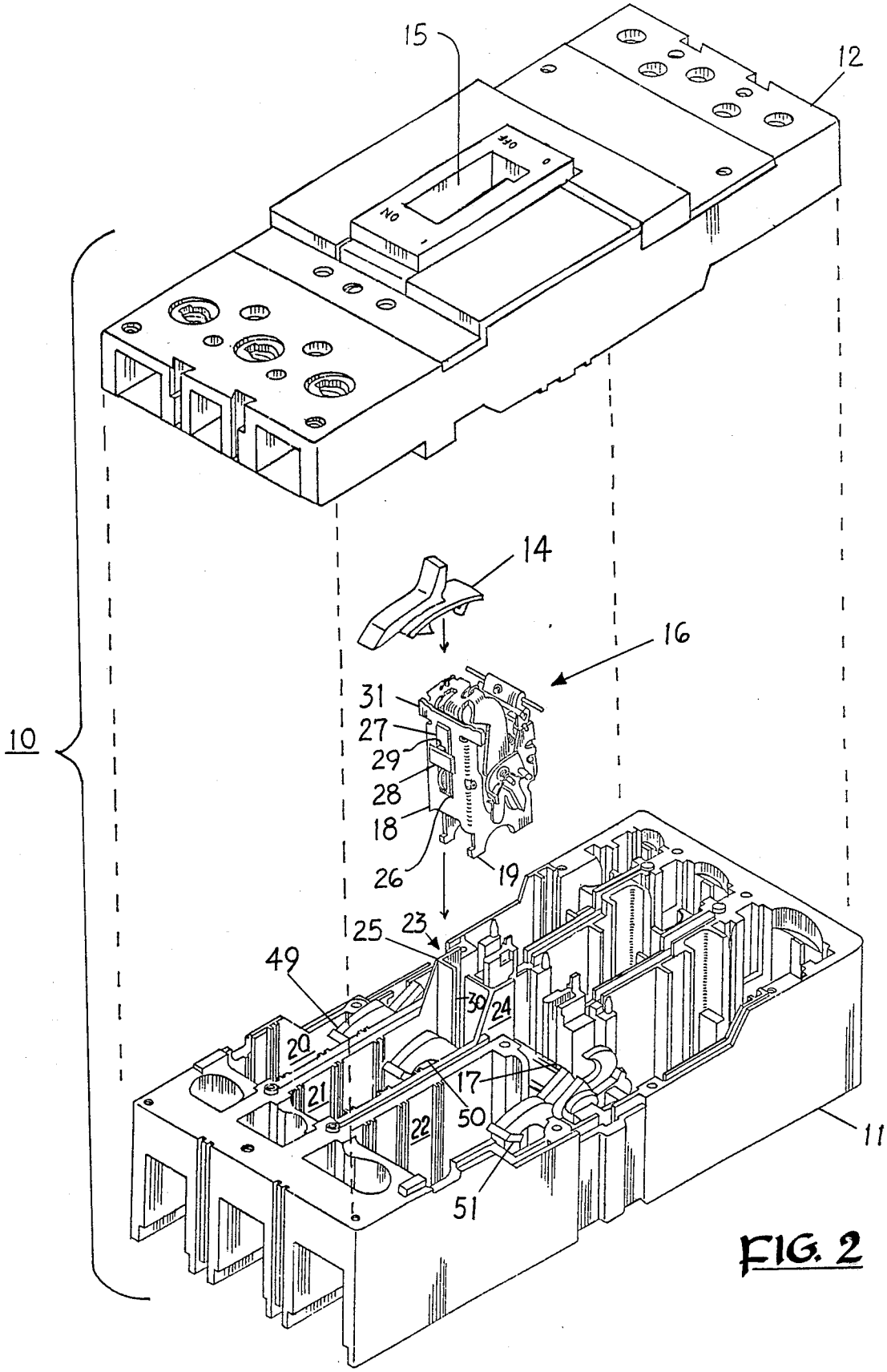
FIG. 2 is a top perspective view in isometric projection of the circuit breaker of FIG. 1 prior to assembly.

An integrated protection unit 10 is shown in FIG. 1 to consist of a case 11 with a cover 12 attached thereto. An accessory cover 13 is attached to the top of the unit cover for providing access to the accessories contained therein. One such integrated protection unit is described within U.S. Pat. No. 4,754,247 which Patent is incorporated herein for purposes of reference. The integrated protection unit includes an operating handle 14 which extends through a slot 15 formed in a top surface of the cover. The integrated protection unit is assembled in an automatic manufacturing process wherein the circuit breaker operating mechanism 16 is assembled off-line before inserting within the circuit breaker case 11 as shown in FIG. 2. The operating mechanism 16 is similar to that described in U.S. Pat. No. 4,736,174, which Patent is incorporated herein for the purposes of reference. The operating mechanism differs from that described within the referenced U.S. Patent by the inclusion of foot extensions 19 on both sides of the bottom of the side frame 18 and the wing-shaped arm extensions 31 provided on the top of the side frames. The circuit breaker case 11 differs from that described within the referenced Patent by the inclusion of an elongated vertical slot 30 formed within the baffle 23 which contains angulated side pieces 24, 25 on opposite sides thereof. To secure the operating mechanism 16 to the circuit breaker case 11, the T-shaped cross piece 28 formed on the insert 27 which extends through the side frame slot 26, includes an upright extension 29 which becomes trapped within the elongated slot when the operating mechanism is inserted within the circuit breaker case. The circuit breaker case includes separate compartments 20, 21 and 22 which house the movable contact arms 49–51 attached to the crossbar assembly 17. A good description of the crossbar assembly is found within U.S. Pat. No. 4,733,211, which Patent is incorporated herein for reference purposes. The operating handle 14 is attached to the top surface of the operating mechanism and extends through the operating handle slot 15 when the circuit breaker cover 12 is later secured to the circuit breaker case 11.

Figure 3A:
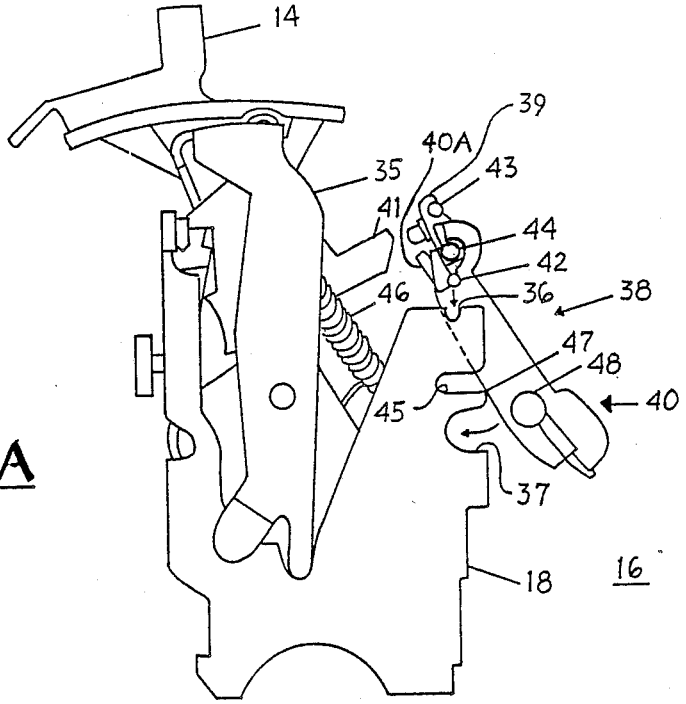
FIGS. 3A and 3B are side views of the operating mechanism of FIG. 2 of the latch subassembly before and after attachment thereto.
Figure 3B:
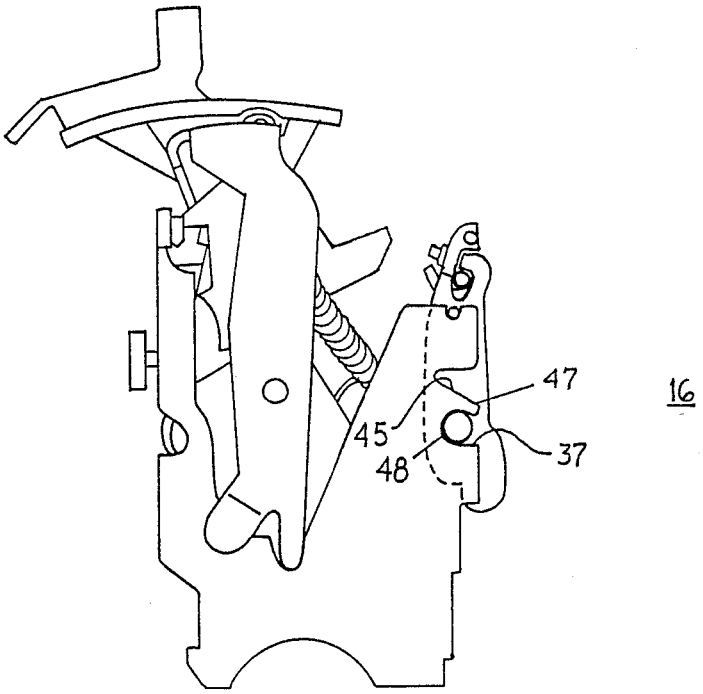

The attachment of the latch assembly 38 to the operating mechanism 16 is depicted in the manner seen by now referring to FIGS. 3A and 3B. The latch assembly 38 is described within aforementioned U.S. Pat. No. 4,736,174 and consists of a secondary latch 39 arranged on a top portion of the latch support frame 40. The secondary latch includes the trip bar 43 which is arranged to pivot within the secondary latch by means of the trip bar pivot 44. The primary latch 40A retains the circuit breaker operating cradle 41 against the trip-bias provided by a pair of powerful operating springs 46 arranged within the handle yoke 35 on either side of the operating cradle 41 as described within aforementioned U.S. Pat. No. 4,736,174. The latch assembly 38 is mounted to the side frame 18 by inserting a pair of mounting posts 42 extending from opposite sides of the latch support frame 40 to within complementary slots 36 formed on the top of the side frames. The latch assembly 38 is next rotated in the clockwise direction about the pivot provided by the mounting posts 42 within the slots 36, to bring the retainer posts 48 extending from opposite sides of the latch support frame to within a corresponding pair of retainer slots 37 formed on opposite sides of the side frames 18. A pair of tabs 47 are integrally formed within the side frames between the retainer slots 37 and the locking slots 45 above the retainer slots 37. When the retainer posts 48 are captured within the retainer slots 37 a screwdriver or similar tool is next inserted within the locking slots 45 and rotated in a clockwise direction to drive the tabs 47 down against the retainer posts 48 to lock the retainer posts within the retainer slots 37.

Figure 4A:
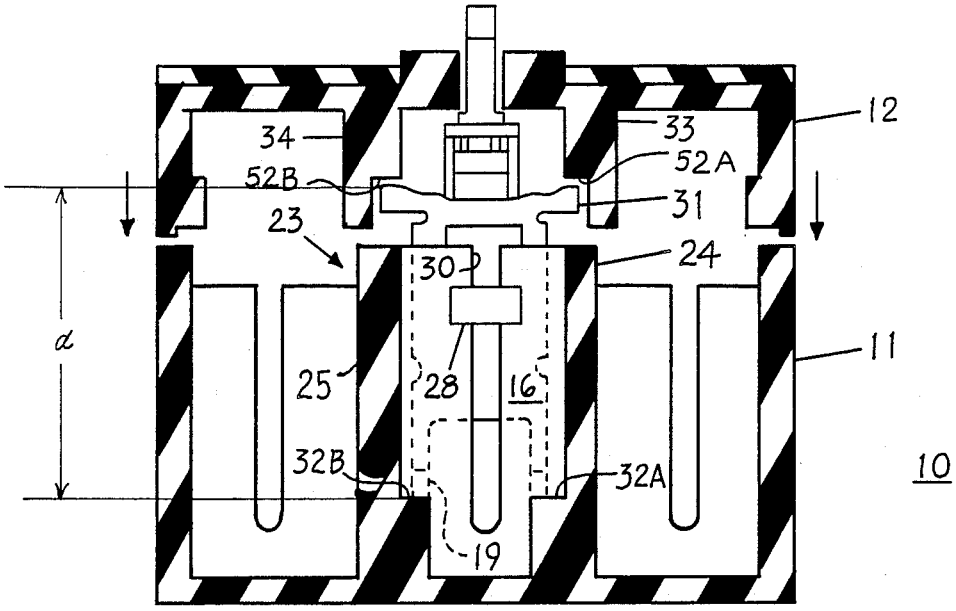
FIGS. 4A and 4B are cross-section views of the circuit breaker of FIG. 1 prior to attachment between the cover and the case.
Figure 4B:
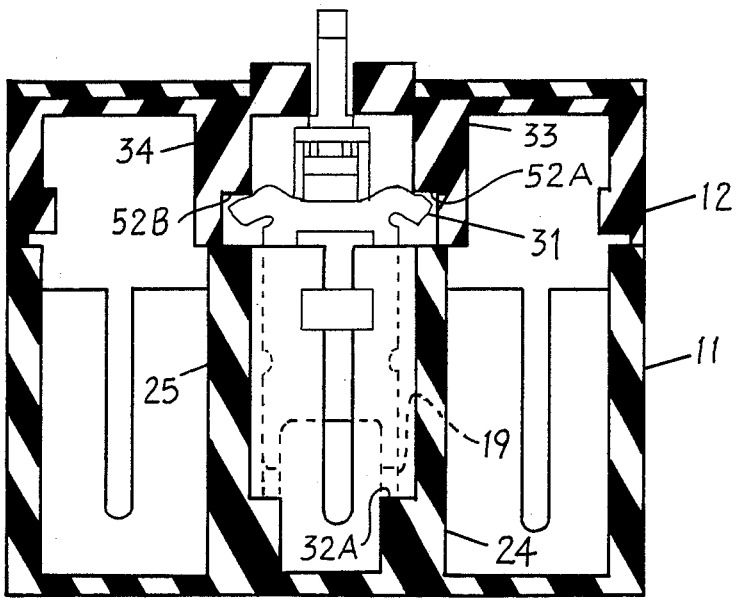

The retention of the operating mechanism 16 within the circuit breaker enclosure defined between the circuit breaker cover 12 and circuit breaker case 11 for the integrated protection unit 10 is best seen by refering now to FIGS. 2, 4A and 4B. The T-shaped crossbar 28 on the operating mechanism 16 is captured within the elongated slot 30 formed within the integrally formed baffle 23 such that the operating mechanism nests between the angulated side pieces 24, 25 formed within the baffle and the leg extensions 19 rest on a pair of corresponding steps 32A, 32B integrally formed on the bottom of the angular side pieces 24, 25 respectively. The position of the leg extensions 19 and the top of the wing-shaped arm extensions 31 is arranged to define a specific distance d. The circuit breaker cover 12 contains complementary baffles 33, 34, with steps 52A, 52B integrally formed therein. The integrated protection unit 10 is depicted in FIG. 4A prior to contact between the circuit breaker cover 12 and the circuit breaker case 11 and before the wing-shaped arm extensions 31 contact the steps 52A, 52B. The specific distance d requires that the wing-shaped arm extensions become deformed during the attachment between the cover 12 and the case 11. This bending or deformation of the wing-shaped extensions automatically adjusts for any manufacturing tolerances that are generated during the fabrication of the case, cover and operating mechanism components. In previous designs employing a machine screw to attach the operating mechanism to the case, the adjustment for such tolerances was made by torquing the machine screw. When the cover 12 of the integrated protection unit 10 is forced in the downward indicated direction into contact with the circuit breaker case 11, the wing-shaped arm extensions 31 on the operating mechanism 16 become deformed upon contact with the steps 52A, 52B integrally formed within the cover baffles 33, 34 as indicated in FIG. 4B to automatically compensate for such manufacturing tolerance variations. When the cover is attached to the case, the operating mechanism becomes press-fitted between the steps 32A, 32B integrally formed within the bottom of the angulated side pieces 24, 25 and the corresponding steps 52A, 52B integrally formed within the cover.

Having thus described our invention, what we claim as new and desire to secure by Letters Patent is:

We claim:

1. A molded case circuit breaker comprising:

a molded plastic case and cover forming an enclosure;

a pair of separable contacts within said enclosure arranged for separation upon occurrence of an overcurrent condition through said contacts; and an operating mechanism within said enclosure intermediate an operating handle and said separable contacts, said operating mechanism including latch means for retaining said separable contacts from being separated in the absence of said over-current condition, said operating mechanism including a pair of arms extending from a top part of said operating mechanism interacting with said cover to retain said operating mechanism within said enclosure said arms becoming deformed when said cover is attached to said case.

2. The molded case circuit breaker of claim 1 including a plurality of legs extending from a bottom part of said operating mechanism and a corresponding plurality of case steps integrally-formed on an interior surface of said case.

3. The molded case circuit breaker of claim 2 wherein said cover includes a pair of parallel and opposing side walls and said case includes a corresponding pair of parallel and opposing side walls and wherein said case steps are separated by a predetermined distance from a top part of said arms, whereby said cover steps contact said top part of said arms before said cover side walls come into contact with said case side walls when said cover is attached to said case.

4. The molded case circuit breaker of claim 1 wherein said operating mechanism includes a pair of opposing side frames, each of said side frames including a first slot formed in a top surface.

5. The molded case circuit breaker of claim 4 wherein said latch means includes a first pair of posts extending from a top part, said first posts being received within said first slots.

6. The molded case circuit breaker of claim 4 wherein said side frames further include second and third slots formed in a side surface, said second and third slots being arranged side by side.

7. The molded case circuit breaker of claim 6 including second and third posts extending from said side part of said latch means, said second and third posts being received within said second and third slots within said side frames.

8. The molded case circuit breaker of claim 7 wherein of said second or third slots is deformed to trap said second or third posts within the other of said second or third slots.

9. The molded case circuit breaker of claim 6 including a pair of tabs defined within said side frames intermediate said second and third slots.

10. The molded case circuit breaker of claim 9 wherein said tabs become displaced over said second or third slots to retain said second or third posts within said second or third slots.

* * * * *

UNITED STATES PATENT AND TRADEMARK OFFICE

CERTIFICATE OF CORRECTION

PATENT NO. : 4,894,632

DATED : January 16, 1990

INVENTOR(S) : Roger N. Castonguay and David J. Meiners

It is certified that error appears in the above-identified patent and that said Letters Patent is hereby corrected as shown below:

On the title page, add:
[73] Assignee: General Electric Company, New York, N.Y.

Signed and Sealed this

Fifth Day of March, 1991

*Attest:*

HARRY F. MANBECK, JR.

*Attesting Officer*

*Commissioner of Patents and Trademarks*